United States Patent [19]

Cooper

[11] 3,954,387

[45] May 4, 1976

[54] BURNERS

[75] Inventor: Charles Frank Cooper, Stourport-on-Severn, England

[73] Assignee: J. Tennant & Sons (Warrington) Limited, Warrington, England

[22] Filed: July 25, 1974

[21] Appl. No.: 491,782

Related U.S. Application Data

[63] Continuation-in-part of Ser. No. 367,377, June 6, 1973, abandoned.

[30] Foreign Application Priority Data

June 8, 1972 United Kingdom ..... 26810/72

[52] U.S. Cl. ..... 431/328; 431/329

[51] Int. Cl.[2] ..... F23D 13/12

[58] Field of Search ..... 431/328, 329

[56] References Cited

UNITED STATES PATENTS

| | | | |
|---|---|---|---|
| 3,170,504 | 2/1965 | Lanning | 431/328 |
| 3,217,701 | 11/1965 | Weiss | 431/328 |
| 3,251,396 | 5/1966 | Nitsche | 431/328 |
| 3,291,188 | 2/1966 | Partiot | 431/328 |
| 3,508,940 | 4/1970 | Nakamura et al. | 106/88 |
| 3,649,315 | 3/1972 | Booth | 106/67 |
| 3,683,058 | 8/1972 | Partiot | 431/328 |

FOREIGN PATENTS OR APPLICATIONS

| | | | |
|---|---|---|---|
| 1,182,949 | 3/1970 | United Kingdom | 431/328 |

*Primary Examiner*—John J. Camby
*Assistant Examiner*—Henry G. Yuen
*Attorney, Agent, or Firm*—Larson, Taylor and Hinds

[57] ABSTRACT

A radiant having gas passages through which a combustible gas mixture can be passed for combustion at the surface of the radiant, characterised by an open high porosity structure of bonded refractory ceramic fibre and a surface configuration of square pyramids, with the gas passages between them.

2 Claims, 5 Drawing Figures

BURNERS

This application is a continuation-in-part of my prior U.S. patent application Ser. No. 367,377 filed June 6, 1973 for a Burner, now abandoned.

BACKGROUND OF INVENTION

The invention relates to gas-fired radiants.

There are many designs of such radiants, in which a combustible gas mixture is burnt at the surface of the radiant after passing through it and heats that surface giving rise to a primarily radiant heat output.

Most known radiants are made in conventional ceramics. In these radiants, exemplified in U.S. Pat. Nos. 1,731,053 Lowe, 3,170,504 Lanning and 3,510,239 Partiot, and Belgian Pat. Nos. 551,940 Huisinga and 558,007 Societe etc. Auer, a variety of structures have been proposed in the attempt to provide high heat output from a given area. Maximisation is required on the one hand of the amount of radiant material exposed to flame and on the other hand of the amount of gas passed and burnt, without risk of flash back. The necessary gas passages however reduce the material available for radiation and proposals have become increasingly complex and expensive to produce, with multiple channels and variously designed protuberances and indentions on which the flames play to increase the visible radiation.

In a further prior proposal, U.S. Pat. No. 3,217,701 Weiss, a radiant heater is in the form of a plain tube, with associated heat reflecting structure, said tube being formed of fibrous material giving a structure of high porosity.

OBJECTS OF THE INVENTION

With the general background in mind, exemplified by the above disclosures, it has been sought to develop a radiant combining high heat output, absence of flashback, and long service life.

Such object has been realised in the radiant described below. Other objects and advantages of the invention will become apparent from the description.

THE INVENTION

It has been found for the desired results a highly specific combination of material and configuration is required.

The invention provides a radiant having gas passages through which a combustible gas mixture can be passed for combustion at the surface of the radiant, characterised by an open high porosity structure of bonded refractory ceramic fibre, the continuous service temperature of fibre and bonding agent being at least about 1000°C and the porosity at last about 70 percent (advantageously 75 to 85 percent), said radiant being further characterised by a surface configuration of raised square pyramids of side about one quarter inch and included angle between adjacent faces about 60°, the gas passages being provided where the corners of adjacent pyramids meet and preferably also where the sides of adjacent pyramids meet, at positions half way between the corners thereof.

Further features of the invention appear in the following description.

GENERAL DESCRIPTION

The radiants of the invention may be made by filter casting a slurry of a bonding agent, such as a bonding clay, and a refractory fibre, for example an alumina silica fibre. The process conditions in filter casting are not critical, the process being insensitive to variations in proportions and type of material, and for example to fibre diameter. Casting may be followed by firing, either in the final shape or as a block or pad subsequently shaped.

In such shaping conventional machining techniques can be applid the pyramids being formed for example by machining two sets of grooves across a flat plate at right angles. The gas passages can then be made by drilling individually or by gang drills, particularly vibratory rather than rotary drills.

If on the other hand the radiant is filter cast in essentially the final form, it may be made complete with the gas passages, formed by means of withdrawable pins.

The radiants of the invention have a desirable combination of service properties, arising from their structure and the high porosity attainable thereby. Porosities unattainable in conventional non-fibrous materials as used for radiants, are readily achieved without resort to foaming, which gives a physically unsatisfactory material. (A typical porosity of conventional radiants is 62 percent).

The new radiants have a high thermal shock resistance, a low thermal conductivity, and a low thermal capacity. In particular the low conductivity and low thermal capacity give a low thermal inertia, so that the radiants heat up rapidly, as discussed further below, and are suitable for application where a speedy response is required.

The response of the bonded fibre used in the radiants of the invention is believed to be due to the inability of individual heated fibres to lose any significant amount of heat by conduction and also to the open structure of the material at a microscopic level, well exposed to heat.

The high thermal shock resistance of the radiants of the invention can be demonstrated by directing water at the hot element. The radiant stops glowing where the water hits it, but recovers in a minute or two and shows no visible physical damage. Conventional radiants would be cracked by such treatment and the advantage of the new radiants for use in adverse enviroments is clear. Railway points heaters and cooking stoves, particularly portable ones for outdoor use, are examples.

The thermal conductivity and low expansion properties of the material allow large radiants, that would crack if made in conventional ceramics, to be made and used without difficulty.

The ceramic fibre best used for the radiants is alumino-silicate fibre, particularly "TRITON" (Trade Mark) fibre, an alumino-silicate material made from fused china clay and having the following properties:

| | |
|---|---|
| Melting Point | 1760°C |
| Continuous Service Temperature | 1260°C max |
| Fibre Diameter, average | 2.8 microns |
| Analysis (within experimental error) | |
| Alumina, $Al_2O_3$ | 45.1% |
| Silica, $SiO_2$ | 51.9 |
| Iron oxide, $Fe_2O_3$ | 1.3 |
| Titania, $TiO_2$ | 1.7 |
| Magnesia, MgO | Trace |
| Calcium oxide, CaO | 0.1 |
| Alkali as $Na_2O$ | 0.2 |

-continued

| | |
|---|---|
| Boric anhydride $B_2O_3$ | 0.08 |

The bonding agent, for example clay, in the amounts used, is found not to affect the volume of the cast as compared to a cast made from the fibre alone, and acts only as a filler in the fibre structure. Considerable variations in binder content are possible, the limits being readily found for a given clay or other binder, for example coloidal silica, between insufficient cohesion in the fired radiant on the one hand and unduly slow casting and low porosity in the final radiant on the other. The peferred content of clay binder is about 2 parts by weight to 5 parts by weight of fibre. The volume of this content of fibre is of course far greater than the volume of the clay.

In United Kingdom Pat. Specification No. 1,225,353 of Morganite Research and Development Limited there are described radiants for surface impingement of flame in for example domestic gas fires, in which the surface has distributed over it a multiplicity of protruding ends of man-made ceramic fibres. The materials of which these radiants are made, and the casting technique, are also suitable for the radiants of the present invention, though the manner in which the radiants are used and hence the configuration of the surface is of course quite different.

DESCRIPTION OF EMBODIMENT

Figure 1:
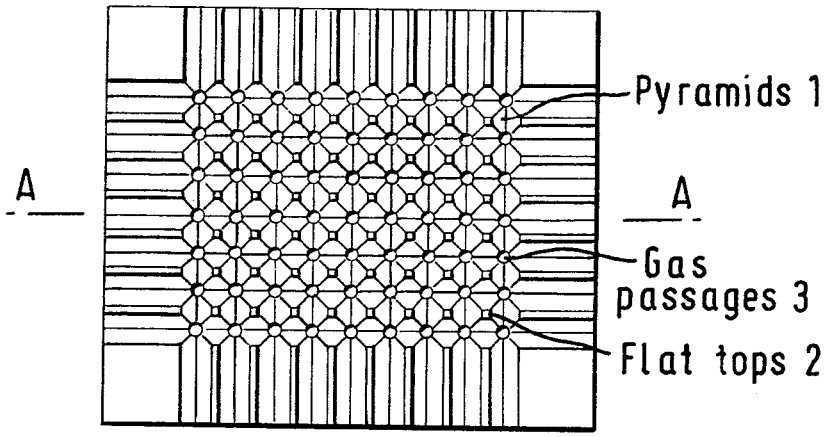
Figure 2:
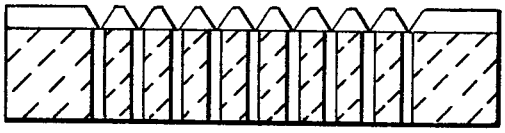

The description has reference to the drawing, in which FIG. 1 is a plan view of a radiant according to the invention and FIG. 2 a sectional view along line A—A of FIG. 1. In FIGS. 1 and 2 the pyramid formations of the radiant are referenced 1 and small flat tops on the pyramids 2; the gas passages are referenced 3.

Figure 3A:
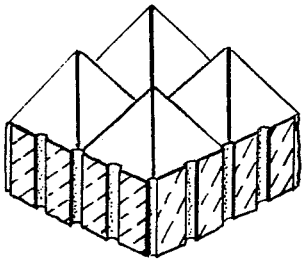
Figure 3B:
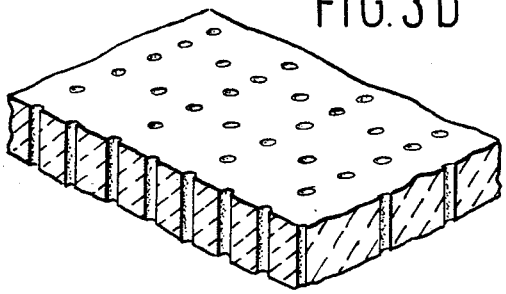
Figure 3C:
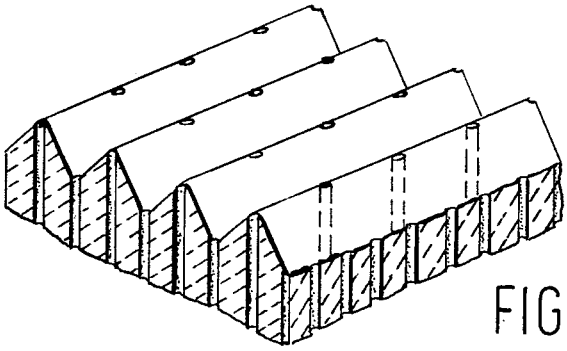

FIGS. 3A, 3B, and 3C have reference to the comparison of Table II.

EXAMPLE I

To make the radiant shown in the drawings 5 parts by weight of the TRITON fibre described above, in lengths of about 6 to 10 inches, two parts by weight of ball clay, and 0.1 part by weight of boron phosphate flux were mixed together with water in a chopper mixer so as to produce a slurry in which the fibre lengths were for the most part between 0.01 and 0.5 inch.

An alternative to the boron phosphate is borax, but since borax is more water soluble than boron phosphate, a larger proportion of borax must be added to the slurry, a proportion of 1.5 parts by weight to 7 parts of the fibre and binder together being suitable. Calcium phosphate is another possible flux.

The slurry was vacuum cast on wire grid former of 72 British Standard mesh (nominal aperture 0.21 mm) to produce a soft, pliable green shape which was dried at 150°C, giving a material that was still soft but brittle. The material was then fired in air at about 1050°C for half an hour, sufficient to bond the fibres. The material became strong enough to resist handling or for example dropping onto a bench from a height of a foot or eighteen inches, though it was still friable if gouged by a steel tool for example.

The thermal conductivity of the cast and fired material was 1.3 B.Th.U. per inch thickness per square foot per hour per °F temperature difference, at a temperature of the material of 600°F. The linear coefficient of expansion per °C was $4 \times 10^{-6}$ and the density 0.5g/cc (31 lb/cu ft.).

The final block was 6 by 4 inches by 0.75 inch thick and had a porosity of 80 percent. In it there were machined 60° vee grooves at 0.25 inch spacings (approx. 0.15 inch deep) along the length of the block and across it. The resulting block had a central area 4 inches by 2.5 inches the surface of which was formed of truncated square pyramids 0.25 inch square at the base and approx. 0.06 inch square at the top. Holes 0.09 inch diameter were then drilled at each intersection of the grooves, for passage of the gas air mixture.

The block was mounted by means of cement in a mild steel box 6 inches by 4 inches and approximately 1 inch deep, in one of the narrow ends of which was drilled centrally a hole of approximately 0.75 inch diameter and attached to which was a metal tube of the same bore and 3 inches long, to serve as an elementary venturi when fed with natural gas from the mains through a suitable jet. In operation the box was held by clamps in an essentially vertical position with tube downwards, though the radiants of the invention, in contrast to conventional gas fire radiants, can be used in any position. By positioning a suitable jet, in this instance that known as the "120 Bray Multihole" jet, centrally and underneath the venturi feeding it with gas at a pressure of approximately 7 inches water gauge, the surface of the block could readily be made to glow when the gas issuing from the holes was ignited. Of particular merit and exemplifying the nature of the radiant of the invention, with low thermal inertia and low thermal conductivity, is the fact that by means of a radiation thermopile it could be demonstrated that the pad achieved 90 per cent of its equilibrium radiated energy in some 50 seconds from ignition, 95 per cent in 100 seconds and was at near peak radiant efficiency in a matter of 3 minutes. or thereabouts. The block showed an excellent uniform "picture" i.e. visual impression of heat radiation, and an uncorrected optical temperature reading of 900° to 925°C. Higher temperatures, readily withstood by the Triton fibre, can be achieved by shielding, in a manner that will be well understood by those skilled in the art.

A variety of gas jet and venturi combinations are possible and will readily be found by those skilled in the art, having regard to the nature and pressure of the gas supply and the general conditions, and having regard further to the size of the gas passages found to be optimum for the gas used and the conditions to give the required gas throughput without risk of flashbacks. For example the particular pad described above has been operated with pipes as short as 1.6 inches and as long as 6 inches and with internal bores as small as 0.5 inch and with a number of single and multiple jets providing a similar gas input to the system.

EXAMPLE II

In a second example a filter casting tool is prepared by sintering 60 mesh B.S.S. phosphor bronze shot on a steel former at 800°C in hydrogen. The tool is about 0.25 inch thick and carries the required pyramid formation in intaglio. For use, the tool is mounted in a suction box to which suction can be applied as before.

For casting, a slurry is prepared from 5 parts Triton fibre chopped to a length of about ⅛ inch in a "Manesty Rotogran Mk. III" sieve type granulator. The fibre is mixed in a blunger with 2 parts by weight china clay, 0.5 part boron phosphate, and 80 parts water for 0.5 to 10 minutes, without added dispersant, and the resulting dispersion filter cast on the tool to a thickness of 3/16 inch. The resulting pad, about 5 inches by 3 inches, is readily removed from the mould without locking of the fibres in the pores or blockage by the small amount of clay passed before the Triton forms an effective filter. The pad is dried, fired at 1050°C, then drilled with 0.054 inch holes.

Mounted in a box supplied with gas and air through a 140 Bray jet feeding a venturi as before, the pad shows a uniform and very satisfactory radiant picture, nothwithstanding the simple configuration, elaborated only by the dimples left by conformation of the casting to the shot at the surface of the tool.

COMPARISON WITH OTHER CONFIGURATIONS

The use of pyramids with a 60° angle between them and quarter inch sides is essential for the highest heat output. At 60° the flames burning at the openings of the gas passages impinge cleanly on the sides of the pyramids with the combusting part of the flame heating their surfaces in a manner not shown for example at 90°, which is too wide for the flame, or 45°, which constricts it. Likewise the spacing, if changed, reduces the output, both visually and to pyrometer measurement. Pyramids of 60° included angle but 5/16 inch spacing are too high for the flames to reach up and show plainly visible 'cold' spots at the tops of the pyramids, while at 3/16 inch spacing the flames interfere with each other and heat output for a given gas input is reduced. Similarly if the configuration is changed, for example even to vee ridges at ¼ inch spacing with a 60° angle between them, heat output drops.

The following comparative results have been taken, all on radiants of 6 inch by 4 inch working area with holes at the corners of the pyramids.

TABLE I

| Configuration | Holes | Jet (Bray) | Pressure (inches water guage) | Heat Output |
|---|---|---|---|---|
| 1/4" pyramids | 3/32" | 180 | 8 1/2 | 460 |
| " | " | 220 | " | 550 |
| 0.18" × 0.165" pyramids | 0.06" | 2 × 100 | " | 390 |

These tests indicate the deleterious results of reducing the pyramid size, the gas through-put in a 180 Bray jet and in 2 × 100 Bray jets being very similar.

The heat output was measured (in arbitrary units) by means of a radiation thermopile 13½ inches from the radiants.

TABLE II

| Configuration | Holes | Heat Output* |
|---|---|---|
| Pyramids ¼" sides 60° included angle between sides of adjacent pyramids ("Standard Pad" Fig. 3a) | 0.053" diam. at corners and half way along sides of pyramids | 340 |
| Flat pad (made by filing a standard pad flat, Fig. 3b) | 0.053" diam. at ⅛" spacing on the sides of a grid of ¼" squares | 265 |
| Ribs ¼" spacing | 0.053 diam. at | 310 |

TABLE II-continued

| Configuration | Holes | Heat Output* |
|---|---|---|
| 60° included angle between ribs (made by filing grooves in the flat pad along the lines of the grid, Fig. 3c) | ⅛" spacing along the valleys and ¼" spacing along the ridges | |

*120 Bray jet at 7" water gauge pressure, output measured as in Table I but at 15" from the radiant pad.

The test pads here all have the same port (gas passage) size and distribution and accordingly give a direct indication of the effect of configuration on heat output.

TABLE III

| Configuration | Holes | Heat Output |
|---|---|---|
| Flat-topped ribs 0.12" high, 0.215" spacing, 60° included angle between ribs | 0.053" diam. at 3/16" spacing in valleys | 290 |
| As last but 0.16" spacing | As last | 245 |
| As last but 0.175" spacing and 45° angle | As last | 250 |

These tests were again done with a 120 Bray jet at 7 inches water gauge pressure, with the heat output measured as in Table II. Since the same jet and pressure was used the gas input was essentially the same as in Table II, but none of the outputs were as good as even the ribbed pad of Table II and the two with the more closely spaced ribs were not as good as the plain pad of Table II.

While numerous configurations, of which the above are examples, have been tried to give simpler tooling for the casting of the radiant pads, none has been found to match ¼inch pyramids for heat output.

The size and number of holes depends on the conditions and gas used, 0.09 or 3/32 inch holes at the corners of the pyramids are satisfactory under most conditions, while 0.053 inch holes at both the corners and half way along the sides ensure that even under the most unfavourable conditions the flame cannot strike back.

I claim:

1. A radiant having a high heat output and high thermal shock resistance comprising a body having an open high porosity structure of bonded refractory ceramic fiber, the continuous service temperature of fiber and bonding agent of said body being at least about 1000°C, said body having gas passages therethrough through which a combustible gas mixture can be passed for combustion at the surface of the radiant and a surface configuration of raised square pyramids of side about one quarter inch and included angle between faces of adjacent pyramids about 60°, said gas passages being provided at corners of said pyramid where base lines of adjacent pyramids intersect, the porosity of said body, exclusive of said gas passages, being at least about 70 percent.

2. A radiant according to claim 1 including gas passages at positions half way along the base lines of adjacent pyramids between the corners of the pyramids.

* * * * *